US006250627B1

(12) United States Patent
Takeuchi et al.

(10) Patent No.: US 6,250,627 B1
(45) Date of Patent: Jun. 26, 2001

(54) SELECTIVE SHEET DELIVERY APPARATUS

(75) Inventors: Masakazu Takeuchi; Kiichiro Noguchi, both of Tokyo (JP); Ryan S Stevenson, Irvine; Peter M. Coombs, Tustin, both of CA (US)

(73) Assignee: Gradco (Japan) Ltd., Tokyo (JP)

( * ) Notice: Subject to any disclaimer, the term of this patent is extended or adjusted under 35 U.S.C. 154(b) by 0 days.

(21) Appl. No.: 09/274,039

(22) Filed: Mar. 22, 1999

(51) Int. Cl.[7] ..... B65H 29/00

(52) U.S. Cl. ..... 271/186; 271/291; 271/296; 271/303

(58) Field of Search ..... 271/291, 296, 271/303, 186, 300

(56) References Cited

U.S. PATENT DOCUMENTS 3,848,867 * 11/1974 Johnson ..... 271/290
3,848,868 * 11/1974 Stemmle ..... 271/291
3,853,314 * 12/1974 Anderson ..... 271/290
4,200,278 * 4/1980 Gindri ..... 271/296
4,216,955 * 8/1980 Avritt et al. ..... 271/296
4,712,786 * 12/1987 Looney ..... 271/207
4,836,529 * 6/1989 Kosaka et al. ..... 271/296
4,900,009 * 2/1990 Kitahara et al. ..... 271/296
5,172,908 * 12/1992 Steinhilber ..... 271/288
5,317,377 * 5/1994 Rubscha et al. ..... 399/401
5,449,158 * 9/1995 Hirota et al. ..... 270/58.18
5,692,747 * 12/1997 Guerrero et al. ..... 271/296
5,860,644 * 1/1999 Takeuchi et al. ..... 271/4.01
5,931,464 * 8/1999 Shimizu et al. ..... 271/296

* cited by examiner

*Primary Examiner*—Donald P. Walsh
*Assistant Examiner*—Daniel K Schlak
(74) *Attorney, Agent, or Firm*—Newton H. Lee, Jr.

(57) ABSTRACT

A printed sheet transporting apparatus has a sheet inlet adjustable to selected heights and including an optional inverter for incoming sheets, a sheet feed path leading to selected positions in which a deflector may be adjustably positioned for deflecting sheets to various receivers for the sheets which are mounted on the apparatus at a plurality of vertically spaced sheet receiving positions.

1 Claim, 7 Drawing Sheets

SELECTIVE SHEET DELIVERY APPARATUS

BACKGROUND OF THE INVENTION

There exist in the prior art devices which include printed sheet receiving inlets to sheet transports which include sheet deflectors for displacing the sheets from the transport and delivering the sheets to a receiving tray of a sheet sorter or stacker.

An example of such prior art is seen in U.S. Pat. No. 4,836,529, granted Jun. 6, 1989 and U.S. Pat. No. 5,048,819, granted Sep. 17, 1991, of Ikegami Tsushinki Co., Ltd.

Other sheet transports of the type generally referred to above include Canon U.S. Pat. No. 4,878,656, granted Nov. 7, 1989 and Minolta U.S. Pat. No. 5,509,645, granted Apr. 23, 1996.

SUMMARY OF THE INVENTION

An object of the present invention is to adapt a sheet feeding and transport system for selective delivery of sheets, inverted or not, from a printer or copier and delivering the sheets to one of a variety of types of sheet receivers or post processing, sorting, stacking, job separating, mailboxing apparatus, selectively applicable at optional vertically spaced locations on the sheet transporting apparatus.

A feature of this invention is that an inverter may or may not be included in an infeed device which carries sheets from the source into the feed path, the infeed device being vertically adjustable to receive sheets from host machines having various output heights and requiring that the sheets be inverted or not.

Another feature of the invention is that the sheet feed path is adapted for delivery of the sheets to one or another of various post processing or receiving devices and has a deflector which is vertically adjustable independently of the sheet feed path to selected locations for delivery of sheets to the selected post processing, stacking or receiving devices. In this connection, the apparatus also includes a sheet bypass in the base of the apparatus which enables the apparatus to be positioned in tandem fashion in conjunction with additional similar devices in combination with a sheet inlet to the apparatus for sheets which are being received in the tandemly arranged second apparatus.

In the performance of the features referred to above, the apparatus includes a sheet transport with which the adjustable infeed is vertically movable (either including or not including the inverter structure) by manual vertical adjustment, as illustrated, or by adjustment by automatic means, and it includes feed rolls engageable with a feed belt in various vertically adjusted presentation of a sheet to the feed path.

DESCRIPTION OF THE PREFERRED EMBODIMENT

Figure 1:
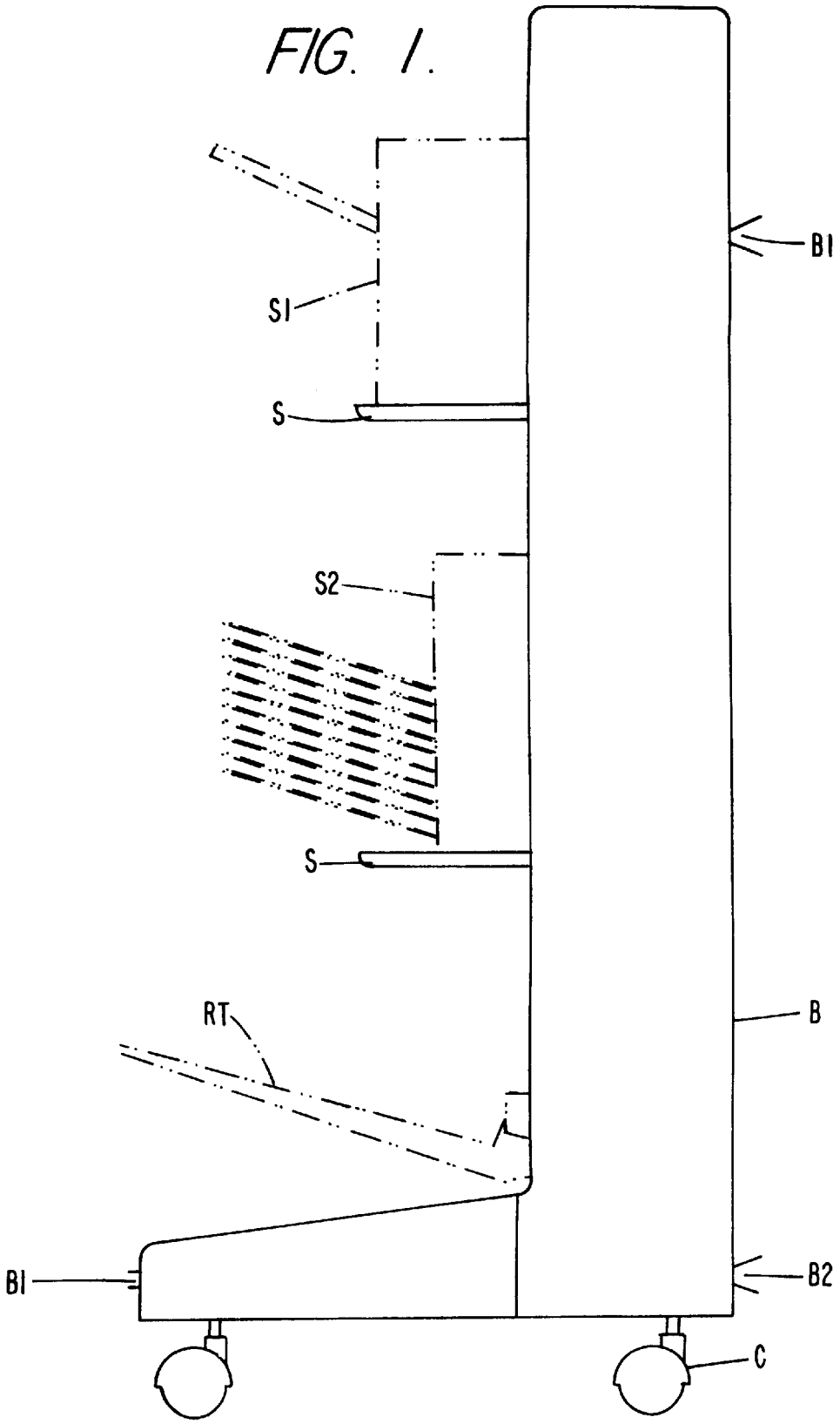
FIG. 1 is a side elevation of the selective sheet delivery apparatus showing in broken lines a variety of types of receivers applicable thereto.

As seen in the drawings, the apparatus of the present invention includes a mobile base B adapted to be supported for movement horizontally on casters C for positioning to receive sheets fed from a copier or printer. The apparatus has a first vertically adjustable infeed I and a bypass infeed B1 and B2.

In normal operation sheets exiting a copier or printer will be fed into the infeed I. In the event that the units are mounted in tandem, sheets will exit the apparatus at the bypass path B1 and enter the tandemed apparatus at bypass entrance B2, as will be later described.

The apparatus further includes shelves S on which may be mounted or located, as desired, a stacker S1 on the upper shelf, a sorter S2 on an intermediate shelf and below the sorter S2, a simple receiving or stacking tray ST.

It is within the purview of the present invention that the stacker S1, the sorter S2 and the tray RT can be vertically arranged at any desired vertical position along the vertical extent of the housing or base B.

As indicated in the Summary of the Invention, it is an object of the invention to adapt a sheet feeding and transport system for selective delivery of sheets, inverted or not, from a printer or copier and delivery of the sheets to one of a variety of sheet receivers, for post processing, sorting, stacking, job separating, etc., which are selectively applicable at optional vertically spaced locations on the sheet transporting apparatus of the invention. Therefore, the base or housing B contains various sheet receiving transporting and discharging mechanisms.

Figure 2:
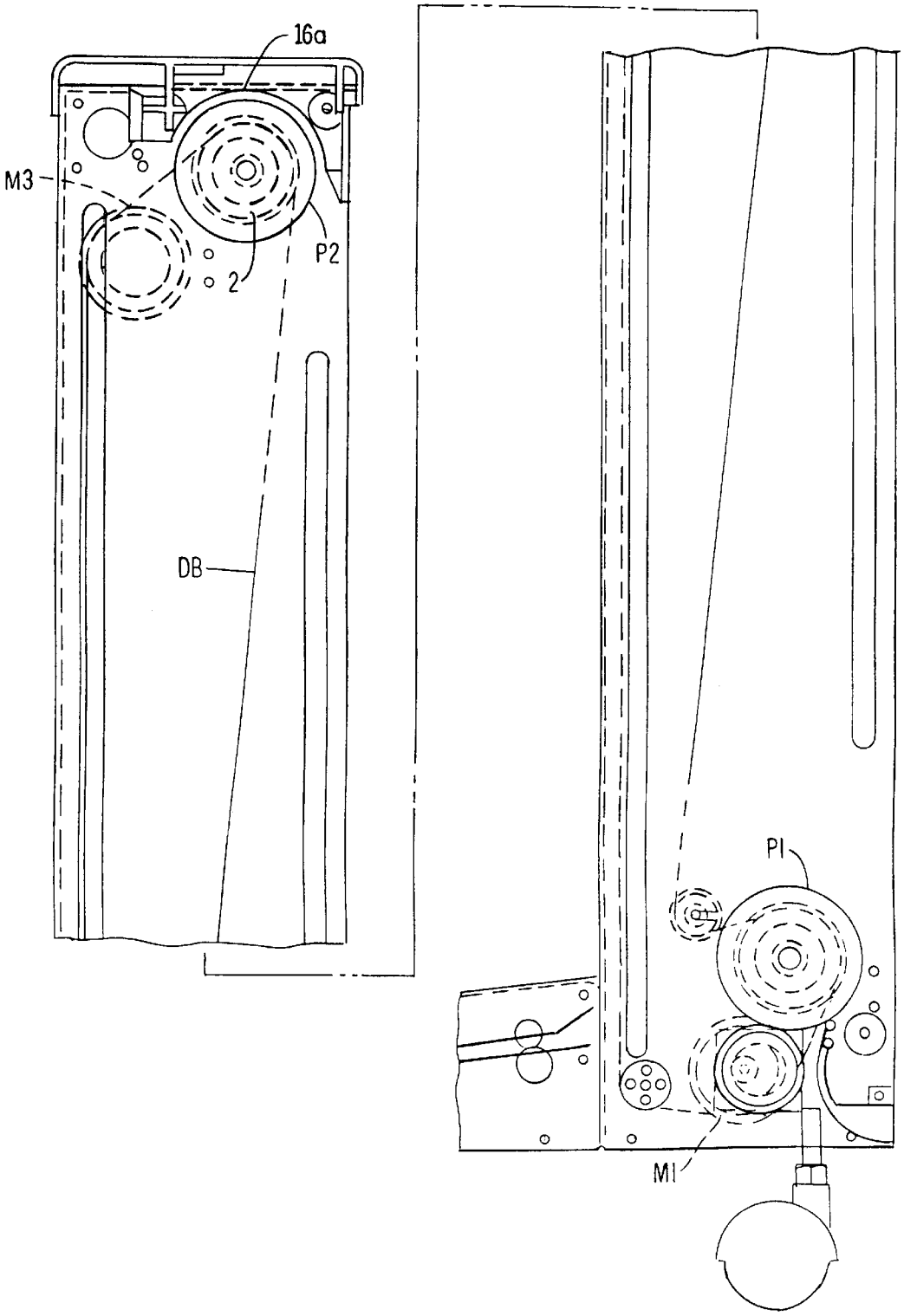
FIG. 2 is a fragmentary vertical section showing the drive system for the paper path, the bulk of the other parts being removed for clarity.

Referring to FIG. 2, a drive system for a paper path is illustrated, such drive system including a motor M1 having a drive belt DB extending about a series of pulleys including lower pulley 1 and upper pulley 2, in a path extending vertically within the housing or base B and adapted to drive lower and upper feed path pulleys P1 and P2.

Figure 3:
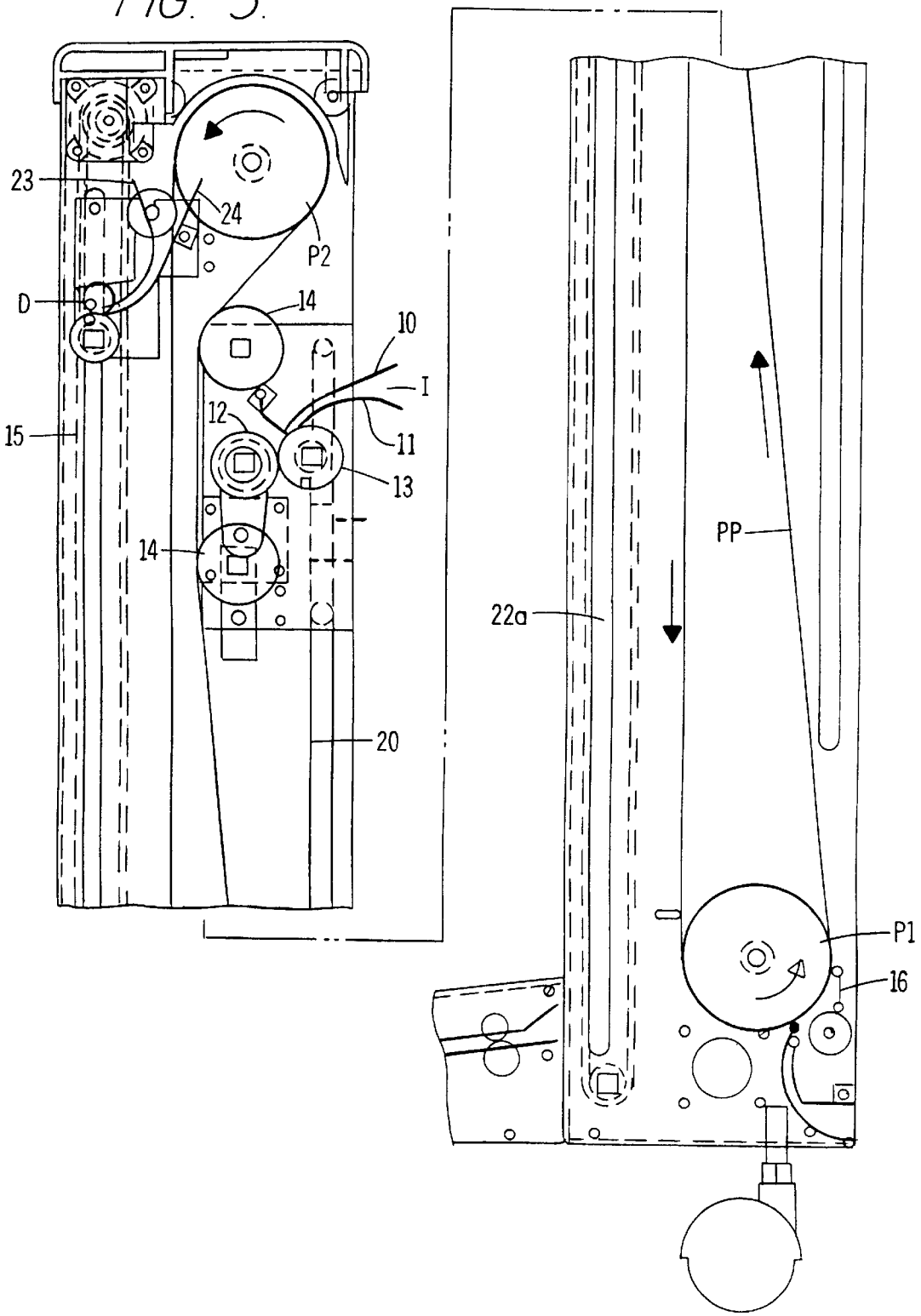
FIG. 3 is a fragmentary section showing the paper feed path including the vertically adjustable optional inverter and the movable deflector.

As seen in FIG. 3., the paper path is shown at PP as extending about the lower and upper pulleys P1 and P2. The sheet inlet I is adapted to be vertically adjustably positioned in a position such that it will receive from the copier or printer at the normal outlet therefrom, a sheet being fed into the apparatus. At this point it will be seen that the sheet infeed includes a downwardly directed pair of divergent plates 10 and 11 which will feed the incoming sheets downwardly between a pair of inversion rolls 12 and 13 driven by an inverter motor M2 which under suitable control and detection means can be reversed when the trailing edge of the sheet is detected so as to feed the incoming sheet upwardly to the upper one of a vertically spaced pair of transport rollers 14, which are in engagement with a belt incorporated in the paper path PP.

The paper path PP is generally known in the state of the art, except for the adjustability of the input thereto to various heights.

In essence, the paper path includes a number of endless belts 15 extending about the pulleys P1 and P2 from the rollers 14 which are engaged with the belts for continuous drive so as to be in paper feeding pressure contact with them. Feed is continued between the belts and associated spring guides 16 which are vertically extensible and retractable on the upper and lower runs of the belts above and below the rolls 14. The spring guides 16 are connected to the vertically adjustable infeed I at 17 and 18 (see FIGS. 5 and 7). Therefore, feed pressure is maintained on sheets passing from the infeed to between the belt at the upwardly extended one and downwardly extended one of the belts. If desired, as shown in the prior art, the spring guides may be laterally offset from the belts, but in any event, are adapted to maintain transport pressure on the sheets of paper to and through the apparatus.

The spring guides are adapted to be retracted by spring loaded spools 19 as the inlet module is moved vertically so as to always maintain the necessary pressure between the belts and the rollers within the vertically adjustable module.

At the upper end, the feed path is released from the spring guides, but arched members 16*a* are provided in the cover to direct sheets to above the upper pulleys.

The free ends of other retractable springs 20 are connected to the top of the vertically adjustable deflector and to rewind spools 21, to maintain feed pressure for movement of the paper downwardly on the opposite side of the feed path, during vertical movement of the deflector D.

Figure 5:
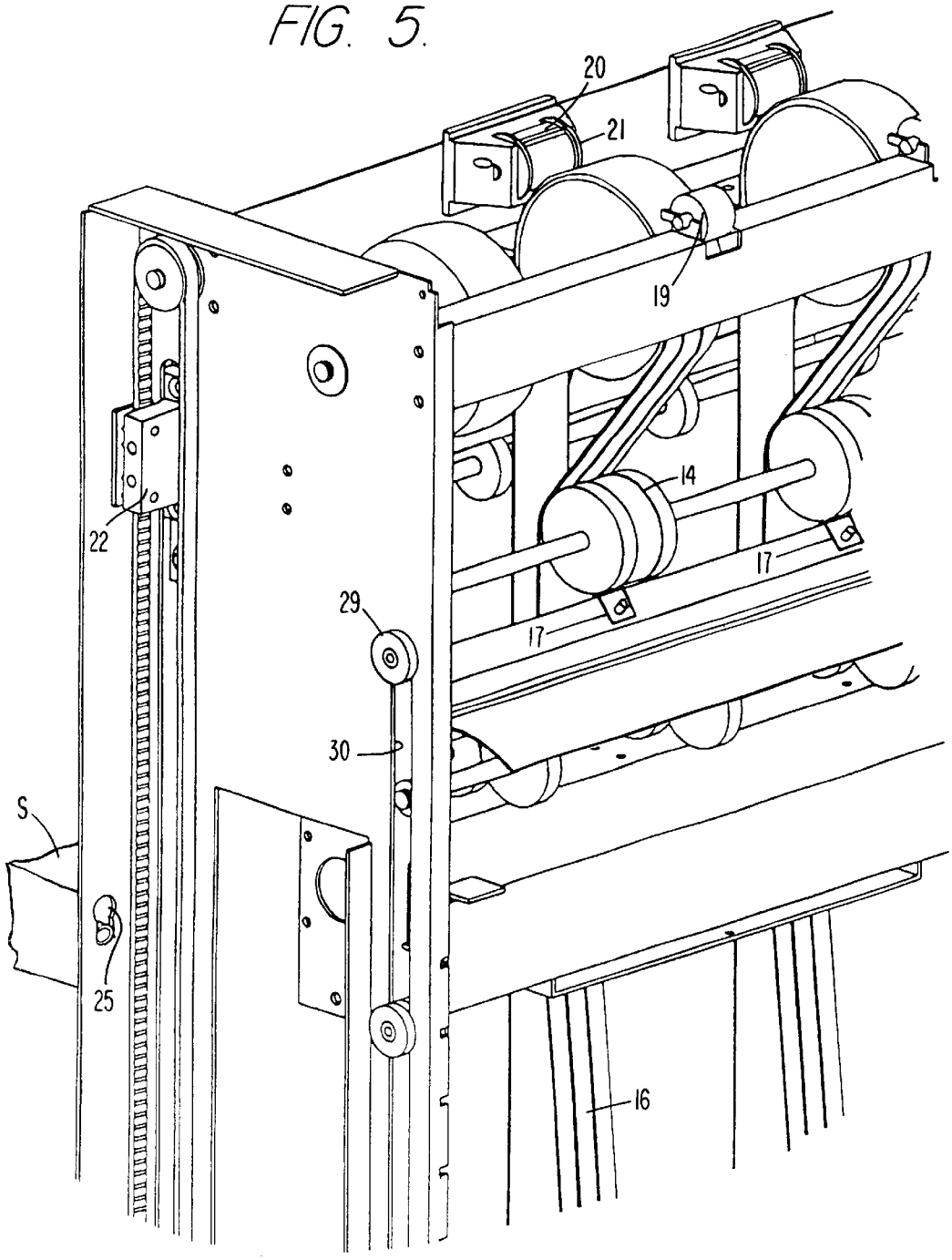
FIG. 5 is an enlarged fragmentary view in perspective showing the details of the feed path and the adjustability of the positions of the paper receiving devices and the co-action of the inverter with the paper path mechanism.
Figure 7:
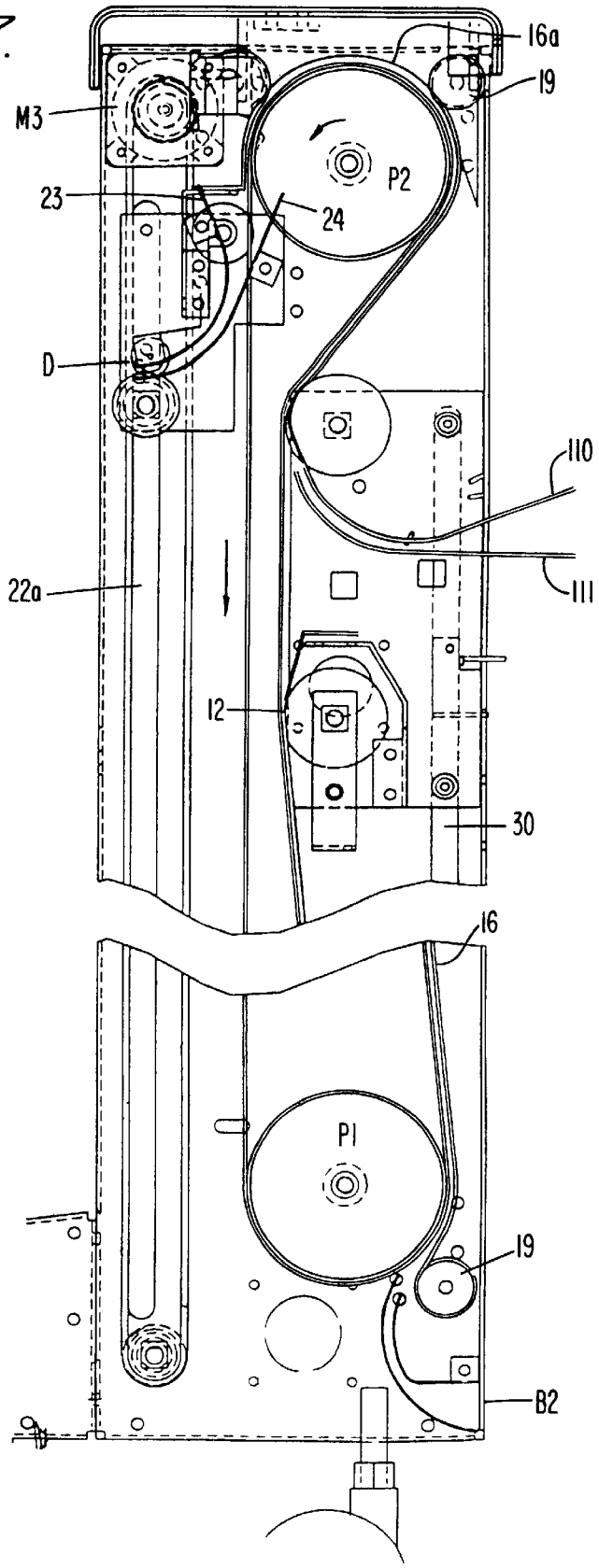
FIG. 7 is a view showing, in vertical section, the infeed device with the inverter removed.

As seen best with reference to FIGS. 5 and 7, the deflector is connected by a clamp 22 to a continuous belt which is driven by a motor M3 to the various vertical heights of adjustment at which the deflector can direct sheets from the transport into a selected receiving apparatus. The deflector moves vertically in a slot 22*a* in the opposite side walls. In order to deflect a sheet from the paper path, the deflector includes fingers 23 and 24 which extend between the belts of the paper transport to strip the paper therefrom as the belt run moves downwardly. This deflection occurs as the runs of the feed path move in the direction of the arrow, depending upon the vertical position of the deflector.

As seen in FIG. 5, the apparatus is provided with means 25, such as bayonet slots and pins, whereby the shelves or the various sheet receiving devices can be interchangeably or removably mounted on the housing or base B.

Figure 6:
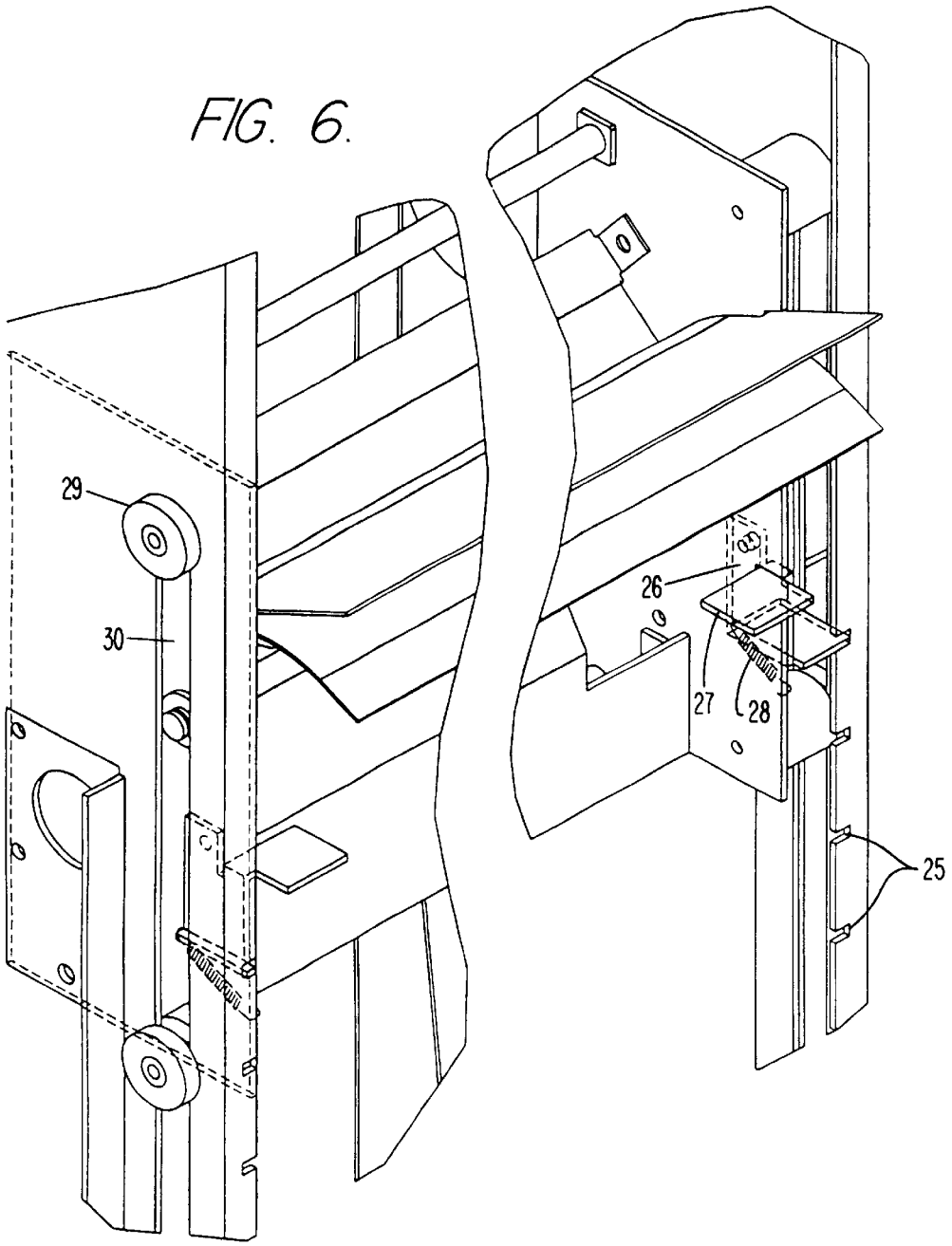
FIG. 6 is a view also taken on the line 5—5 of FIG. 4, but illustrating the adjustable inverter mechanism and the means for adjusting its vertical position with respect to various paper infeed heights of a copier or a printer.

As seen in FIGS. 6 and 7, the input module I is vertically adjustable by means of a series of vertical notches 25 formed in the side walls of the housing structure and levers 26 which are adapted to normally engage in the notches but to be pivotally moved from the notches by thumb pieces 27 forming part of the levers, the levers being held engaged in the notches by the coiled springs 28 at each side of the assembly.

The input module has rollers 29 mounted thereon which are vertically movable in vertically extended slots 30 in the side walls for stability at any selected position of the module.

As seen in FIG. 7, the inversion mechanism has been removed from the infeed module, for use of the apparatus in the event that the nature of the copier or printer, which supplies sheets to the module, does not require inversion of the sheets. Also, in that case, the module is modified by installing inlet guides 110 and 111 which lead upwardly to the upper infeed roller, so that the leading edge of the incoming sheet is picked up between the means defining the feed path and that particular roller 14 for delivery in an upward direction, initially.

Figure 4:
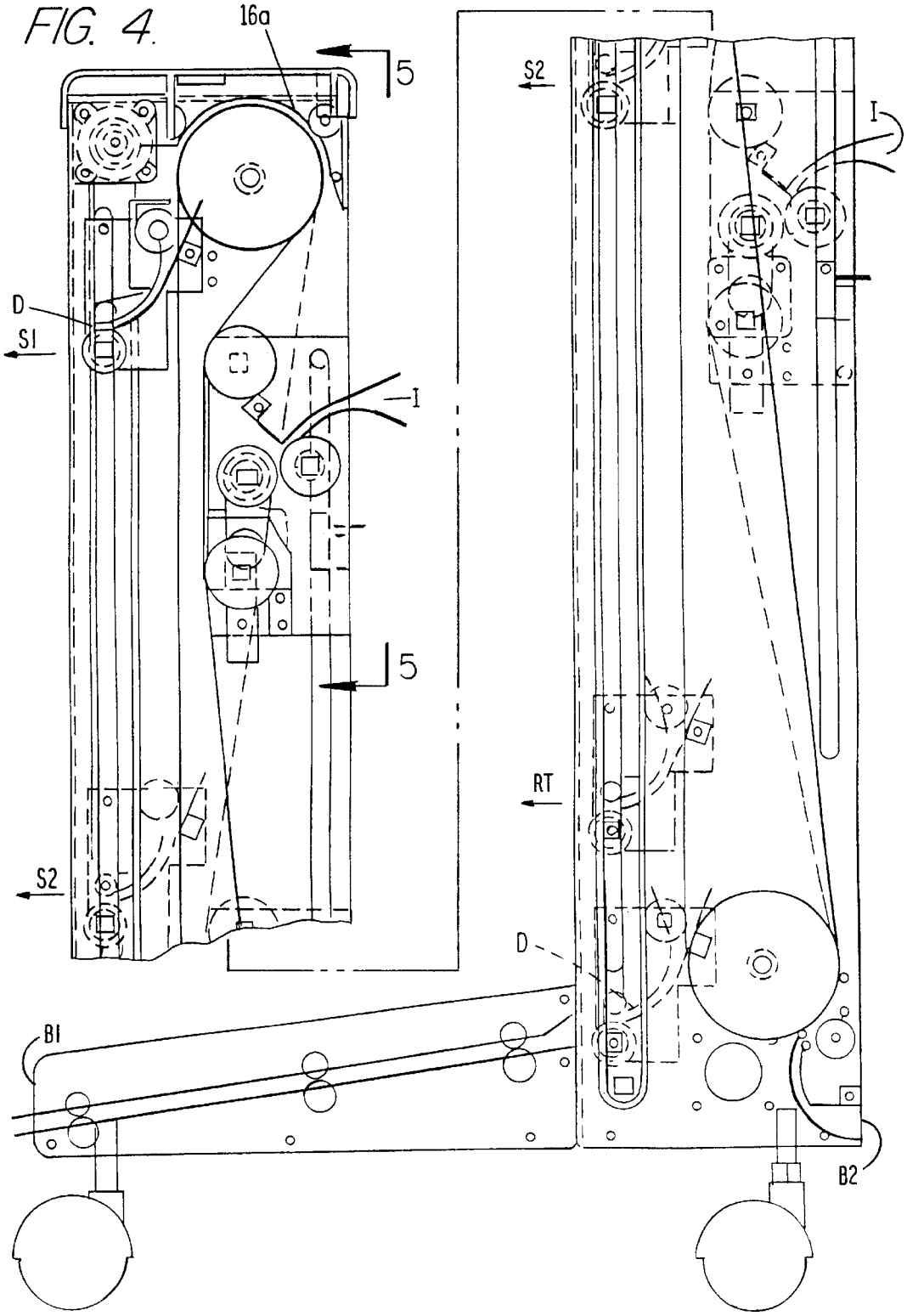
FIG. 4 is a view generally corresponding with FIG. 3, but showing the paper feed path operable in conjunction with the vertically adjustable inverter and together with the vertically adjustable deflector shown in various vertically adjusted positions.

Preferably the apparatus is adapted to be used in tandem with an identical apparatus. In such a case, as seen in FIG. 4, when the deflector is at its lowermost position, the sheets will be deflected into a bottom section of the housing in which are mounted suitable feed rollers and drive means therefor, whereby sheets will be fed from the bottom of the housing at B1 to the lower inlet guide B2 at the bottom of the paper path PP, and then fed upwardly to the lower feed rollers of the input module, between the belts and the input module, and then transported to the upper rollers of the input module for continued transport to the diverter D.

Having thus described the invention, the scope will be defined by the following claims.

What is claimed is:

1. A printed sheet transport apparatus comprising: a vertically extended structure supporting a sheet inlet means, sheet transport means, including belts extending vertically in the apparatus for receiving sheets from said sheet inlet means, vertically movable sheet deflector means for removing sheets from said transport means, means for vertically adjusting said sheet deflector means to various heights of vertical adjustment, and means for supporting a plurality of sheet receivers on said apparatus for receiving sheets at selected vertical positions of said sheet deflector means, wherein said inlet means is vertically adjustable within said vertically extended structure and includes a pair of vertically spaced sheet feeding rolls constituting a portion of said sheet transport means, inversion roll means in said inlet means for inverting sheets supplied thereto and operable to deliver an inverted sheet upstream to said sheet feeding rolls, and inlet guide means for guiding sheets to said inversion roll means.

* * * * *